US005447141A

United States Patent [19]

Kitamoto et al.

[11] Patent Number: 5,447,141

[45] Date of Patent: Sep. 5, 1995

[54] EVAPORATIVE EMISSION CONTROL SYSTEM FOR INTERNAL COMBUSTION ENGINES

[75] Inventors: Masakazu Kitamoto; Takafumi Nishikawa; Shun Masuda, all of Wako, Japan

[73] Assignee: Honda Giken Kogyo Kabushiki Kaisha, Tokyo, Japan

[21] Appl. No.: 338,219

[22] Filed: Nov. 9, 1994

[30] Foreign Application Priority Data

Nov. 9, 1993 [JP] Japan ..... 5-064957 U

[51] Int. Cl.[6] ..... F02M 33/02

[52] U.S. Cl. ..... 123/520; 123/198 D

[58] Field of Search ..... 123/520, 198 D, 519, 123/518, 516, 521

[56] References Cited

U.S. PATENT DOCUMENTS

| | | | |
|---|---|---|---|
| 5,158,054 | 10/1992 | Otsuka | 123/198 D |
| 5,172,672 | 12/1992 | Harada | 123/198 D |
| 5,178,117 | 1/1993 | Fujimoto | 123/518 |
| 5,215,061 | 6/1993 | Ogawa | 123/520 |
| 5,259,355 | 11/1993 | Nakashima | 123/520 |
| 5,299,544 | 4/1994 | Kitamoto | 123/520 |
| 5,359,980 | 11/1994 | Tomisawa | 123/520 |

FOREIGN PATENT DOCUMENTS

| | | | |
|---|---|---|---|
| 2-26754 | 2/1990 | Japan . | |
| 5018326 | 1/1993 | Japan | 123/519 |
| 6058213 | 3/1994 | Japan | 123/520 |
| 6074103 | 3/1994 | Japan | 123/520 |

*Primary Examiner*—Carl S. Miller

*Attorney, Agent, or Firm*—Nikaido, Marmelstein, Murray & Oram

[57] ABSTRACT

An evaporative emission control system for an internal combustion engine detects abnormality of the system based on pressure within a purging passage at a location between a purge control valve arranged therein and an intake passage of the engine, and pressure within a canister for adsorbing evaporative fuel generated from a fuel tank of the engine, when it delivers a valve opening command to open the purge control valve.

5 Claims, 4 Drawing Sheets

EVAPORATIVE EMISSION CONTROL SYSTEM FOR INTERNAL COMBUSTION ENGINES

BACKGROUND OF THE INVENTION

1. Field of the Invention

This invention relates to an evaporative emission control system for an internal combustion engine, and more particularly to an evaporative emission control system of this kind equipped with a function of detecting abnormality of the system.

2. Prior Art

Conventionally, an evaporative emission control system has been used for an internal combustion engine installed on an automotive vehicle, which prevents evaporative fuel generated from a fuel tank of the engine from being emitted into the atmosphere. This system temporarily stores evaporative fuel in a canister thereof, and purges the stored evaporative fuel into the intake system of the engine via a purging passage thereof.

Japanese Provisional Utility Model Publication (Kokai) No. 2-26754 discloses an evaporative emission control system of this kind as shown in FIG. 1, which is comprised of a canister 101, a purging passage 102 connecting between the canister 101 and an intake pipe of the engine, a purge control valve 103 arranged across the purging passage 102, and a pressure sensor 104 arranged in communication with the purging passage at an intermediate location thereof for detecting pressure within the purging passage, thereby detecting abnormality of the system based on pressure within the purging passage detected by the pressure sensor 104 and pressure within the intake pipe.

In the conventional system, however, the pressure sensor 104 is required to detect even a subtle change in the pressure in the purging passage caused by opening and closing of the purge control valve 103, due to a small flow resistance of the canister 101, and hence high detecting accuracy is required of the pressure sensor 104.

Further, in a variation of the conventional system where the pressure sensor 104 is arranged in the purging passage 2 at a location between the purging control valve 103 and the intake pipe of the engine, a pressure level detected when the purge control valve 103 is closed is lower than one detected when the pressure control valve 103 is open. However, in the course of use of the canister 101, the flow resistance thereof increases, so that a change in the pressure caused by opening and closing of the purge control valve 103 progressively decreases, and hence in this variation as well, the pressure sensor 104 is required to have high detecting accuracy.

SUMMARY OF THE INVENTION

It is the object of the invention to provide an evaporative emission control system for internal combustion engines, which is capable of detecting abnormality of the system without employing a pressure sensor or the like having high detecting accuracy.

To attain the object, the present invention provides an evaporative emission control system for an internal combustion engine having a fuel tank and an intake passage, including a canister for adsorbing evaporative fuel generated from the fuel tank, a purging passage connecting between the canister and the intake passage, for purging a mixture of the evaporative fuel and air from the canister into the intake passage, a purge control valve arranged at the purging passage for controlling a flow rate of the evaporative fuel purged into the intake passage via the purging passage, and control means for delivering a valve opening command for opening the purge control valve.

The evaporative emission control system according to the invention is characterized by comprising:

abnormality-detecting means for detecting abnormality of the evaporative emission control system, based on pressure within the purging passage at a location between the purge control valve and the intake passage and pressure within the canister, when the control means delivers the valve opening command.

Preferably, the abnormality-detecting means comprises a pressure detection passage extending between the canister and a portion of the purging passage downstream of the purge control valve, and a differential pressure-responsive element connected to the pressure detection passage for operation responsive to a difference between pressure in or from the canister and pressure in the purging passage at the location between the purge control valve and the intake passage.

More preferably, the differential pressure-responsive element comprises a first pressure chamber communicating with an interior of the canister, a second pressure chamber communicating with an interior of the purging passage, and a movable element interposed between the first pressure chamber and the second pressure for operation responsive to a differential pressure between the first pressure chamber and the second pressure chamber.

Further preferably, the differential pressure-responsive element comprises a pressure sensor for detecting the differential pressure between the first pressure chamber and the second pressure chamber, and the abnormality-detecting means includes determining means for determining that the evaporative emission control system is abnormal if the differential pressure detected by the pressure sensor when the control means delivers the valve opening command is above a predetermined value.

Alternatively, the differential pressure-responsive element comprises a differential pressure-type pressure switch disposed for switching operation responsive to the differential pressure between the first pressure chamber and the second pressure chamber.

The above and other objects, features, and advantages of the invention will become more apparent from the following detailed description taken in conjunction with the accompanying drawings.

DETAILED DESCRIPTION

The invention will now be described in detail with reference to drawings showing an embodiment thereof.

Figure 1:
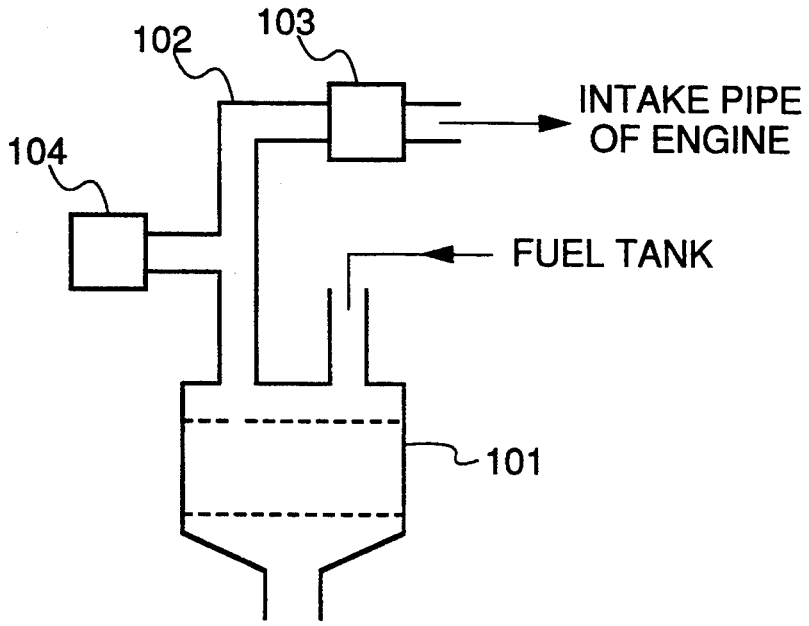
FIG. 1 a schematic diagram showing a conventional evaporative emission control system.
Figure 2:
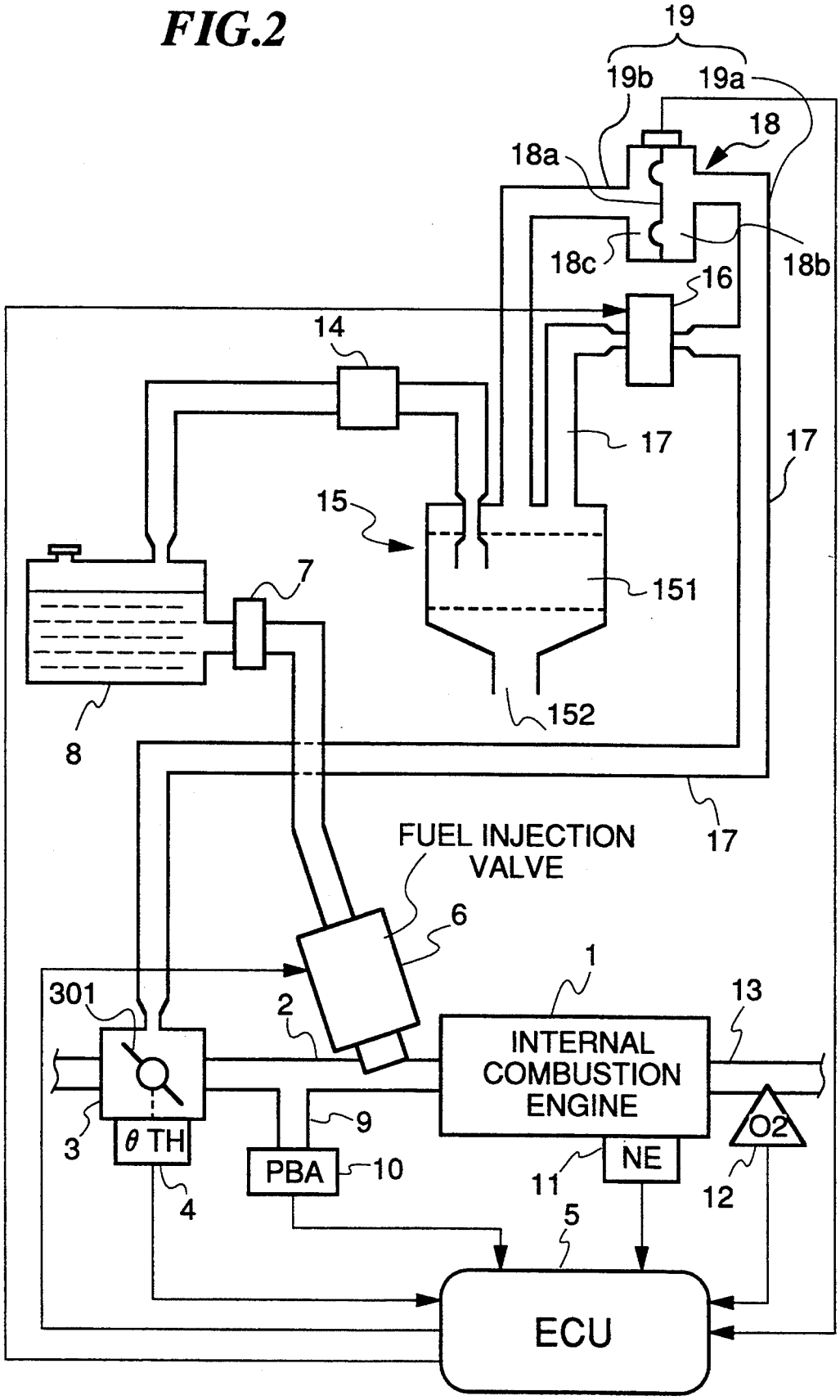
FIG. 2 is a block diagram showing the whole arrangement of a fuel supply control system for an internal combustion engine, which incorporates an evaporative emission control system according to an embodiment of the present invention.

Referring first to FIG. 2, there is shown the whole arrangement of a fuel supply control system for an internal combustion engine, which incorporates an evaporative emission control system according to an embodiment of the invention. In the figure, reference numeral 1 designates a four-cylinder internal combustion engine (hereinafter referred to as "the engine"), including an intake pipe 2 having a throttle body 3 arranged thereacross which accommodates a throttle valve 301 therein. A throttle valve opening ($\theta$TH) sensor 4 is connected to the throttle valve 3 for generating an electric signal indicative of the sensed throttle valve opening $\theta$TH and supplying same to an electronic control unit (hereinafter referred to as the ECU") 5.

Fuel injection valves 6 are each provided for each of cylinders of the engine, and arranged in the intake pipe 2 between the engine 1 and the throttle valve 301 at a location slightly upstream of intake valves, not shown. The fuel injection valves 6 are connected via a fuel pump 7 to a fuel tank 8, and electrically connected to the ECU 5 to have their valve opening periods controlled by signals therefrom.

On the other hand, an intake pipe absolute pressure (PBA) sensor 10 is mounted at an end of a branch conduit 9 branching off from the intake pipe 2 at a location immediately downstream of the throttle valve 103, for sensing absolute pressure (PBA) within the intake pipe 2, and is electrically connected to the ECU 5 for supplying an electric signal indicative of the sensed absolute pressure PBA to the ECU 5.

An engine rotational speed (NE) sensor 11 is arranged in facing relation to a camshaft or a crankshaft of the engine 1, neither of which is shown. The ME sensor 11 generates a pulse as a TDC signal pulse at each of predetermined crank angles whenever the crankshaft rotates through 180 degrees, the pulse being supplied to the ECU 5.

An $O_2$ sensor 12 as an exhaust gas component concentration sensor is arranged in an exhaust pipe 13 of the engine for detecting the concentration of oxygen contained in exhaust gases and supplying an electric signal responsive to the detected oxygen concentration to the ECU 5.

The evaporative emission control system is provided between the fuel tank 8 and the intake pipe 2, which is comprised of a two-way valve 14 formed of a positive pressure valve and a negative pressure valve, neither of which is shown, a charging passage 30 across which the two-way valve 14 is arranged, and which extends between the fuel tank 8 and a canister 15, the canister 15 accommodating an adsorbent 151, a purging passage 17 extending between the canister 15 and the intake pipe 2 of the engine 1, and a purge control valve 16 arranged across the purging passage 17 and formed by an electromagnetic valve with a solenoid, not shown, for driving a valving element thereof, not shown. The solenoid of the purge control valve 16 is electrically connected to the ECU 5 to have opening/closing operations thereof controlled by a control signal delivered from the ECU 5. With the above arrangement, the evaporative emission control system operates such that evaporative fuel (fuel vapor) generated from the fuel tank 8 increases pressure within the charging passage 30 on the fuel tank side, and forces the positive pressure valve of the two-way valve 14 to open when the pressure exceeds a predetermined level, to flow into the canister 15, where it is adsorbed by the adsorbent 151 charged in the canister 15. When the purge control valve 16 is opened in response to the control signal from the ECU 5, negative pressure developed within the intake pipe 2 is introduced into the purging passage 17 via the purge control valve 16, so that air is introduced into the canister 15 from the outside via an air-inlet port 152 provided in the canister 15, whereby evaporative fuel temporarily stored in the canister 15 is drawn into the intake pipe 2 together with the air introduced into the canister 15. When the fuel tank 8 is cooled by an outside air so that negative pressure is developed therein, the negative pressure valve of the two-way valve 14 is opened to permit evaporative fuel temporarily stored in the canister to return to the fuel tank 8. Thus, evaporative fuel generated from the fuel tank 8 is prevented from being emitted into the atmosphere.

A pressure detection passage 19 extends between the canister 15 and a portion of the purging passage 17 downstream of the purge control valve 16, and across which is arranged a pressure sensor 18. The pressure sensor 18 is comprised of a diaphragm **18*a*, and first and second pressure chambers 18*b* and 18*c* defined by the diaphragm 18*a* on opposite sides thereof, the first pressure chamber 18*b* communicating with a portion 19*a* of the pressure detection passage 19 connected to the intake pipe 2 via the purging passage 17, and the second pressure chamber 18*c* with a portion 19*b* of the pressure detection passage 19 connected to the canister 15. The diaphragm 18*a* is displaceable in response to a difference in pressure (differential pressure) between the first and second pressure chambers 18*b*, 18*c*, and the pressure sensor 18 supplies a signal indicative of the differential pressure to the ECU 5**.

The ECU 5 is comprised of an input circuit having the functions of shaping the waveforms of input signals from various sensors mentioned above, shifting the voltage levels of sensor output signals to a predetermined level, converting analog signals from analog-output sensors to digital signals, and so forth, a central processing unit (hereinafter referred to as the "CPU") having a function of executing a program for calculating a control parameter for control of the purge control valve 16 and so forth, memory means storing various operational programs which are executed by the CPU and for storing results of calculations therefrom, etc. and an output circuit which outputs driving signals to the fuel injection valves 6, the purge control valve 16, and so forth.

The ECU 5 controls the opening/closing operation of the purge control valve 16 in dependence on operating conditions of the engine, and detects abnormality of the evaporative emission control system based on the differential pressure detected by the pressure sensor 18.

More specifically, the ECU 5 determines that the evaporative emission control system is abnormal if the differential pressure detected by the pressure sensor 18 exceeds a first predetermined value when the ECU 5 delivers a valve-opening command to the purge control valve 16. For example, if the purge control valve 16 does not open even when the valve-opening command is delivered thereto or if a portion of the purging passage 17 closer to the canister than the purge control valve 16 is clogged with an alien substance or the like, the differential pressure detected by the pressure sensor 18 is extraordinarily large, whereby it is determined that the evaporative emission control system is abnormal.

According to the present embodiment, there occurs a significant or large change in the detected differential pressure irrespective of whether the flow resistance of the canister 15 is large or small, which makes it possible to accurately detect abnormality of the evaporative emission control system (particularly of the purge control valve 16) without using a special high-accuracy type pressure sensor for the pressure sensor 18.

Figure 3:
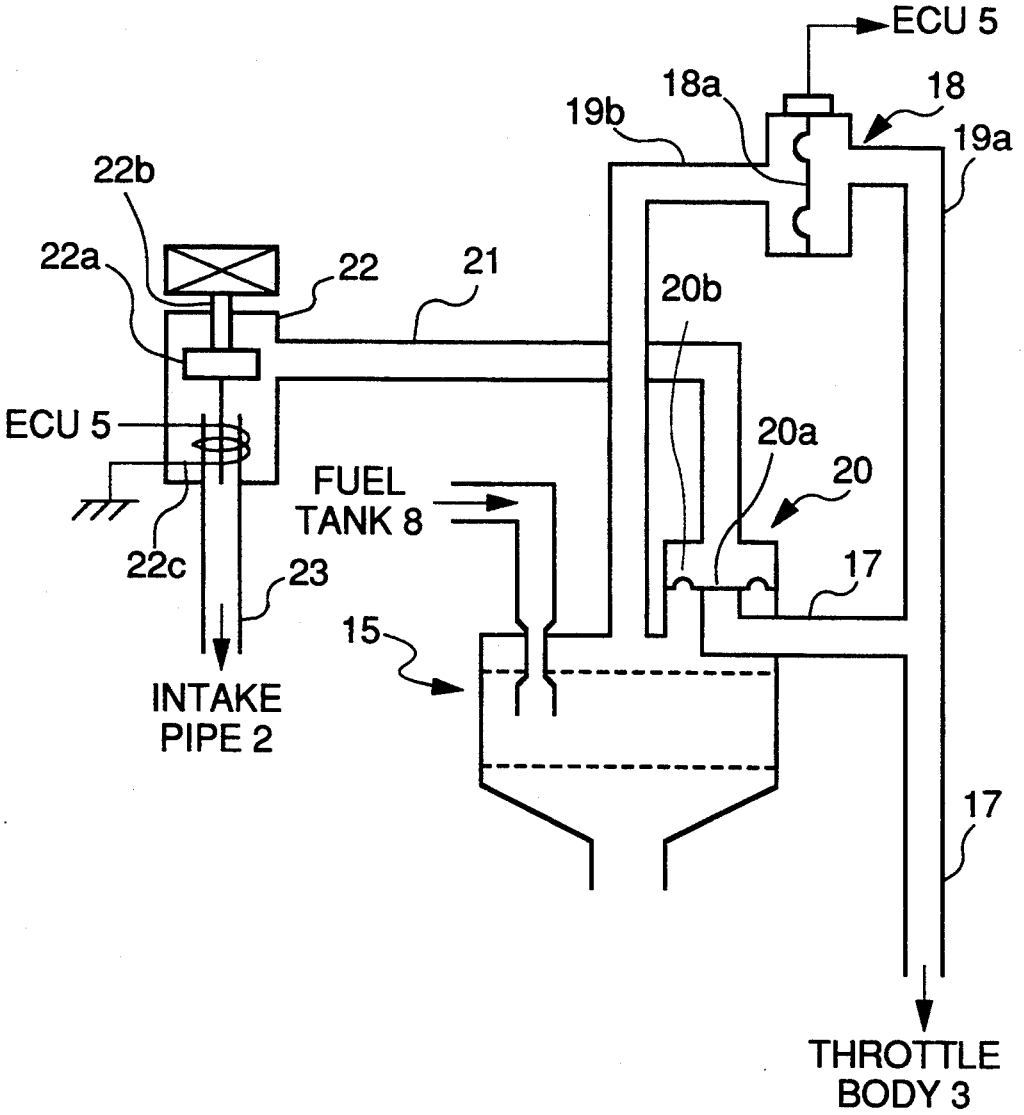
FIG. 3 is a block diagram showing a variation of the embodiment shown in FIG. 2.

FIG. 3 shows a variation of the embodiment described above. In this variation, a pressure-responsive type control valve 20 is employed in place of the purge control valve 16 formed by an electromagnetic valve, used in the above embodiment. The control valve 20 is formed integrally with the canister 15 and arranged at an end of the purging passage 17 such that the purging passage 17 is opened and closed by movement of a valving element 20*a* of the control valve 20. The control valve 20 has a pressure chamber 20*b* defined by the valving element 20a formed by a diaphragm and communicated via a conduit 21 to an electromagnetic valve 22, which in turn is communicated with the atmosphere via a pipe 22*b* as well as with the intake pipe 2 at a location downstream of the throttle valve 301 via a pipe 23. The electromagnetic valve 22 has a solenoid 22*c* electrically connected to the ECU 5, and blocks off the pipe 23 when it is energized and blocks off the pipe 22*b* when it is deenergized, so that the purge control valve 20 performs opening/closing operation according to energization/deenergization of the solenoid valve 22*c*. The remaining part of this variation is identical in construction to the embodiment shown in FIG. 2, description of which is omitted.

Figure 4:
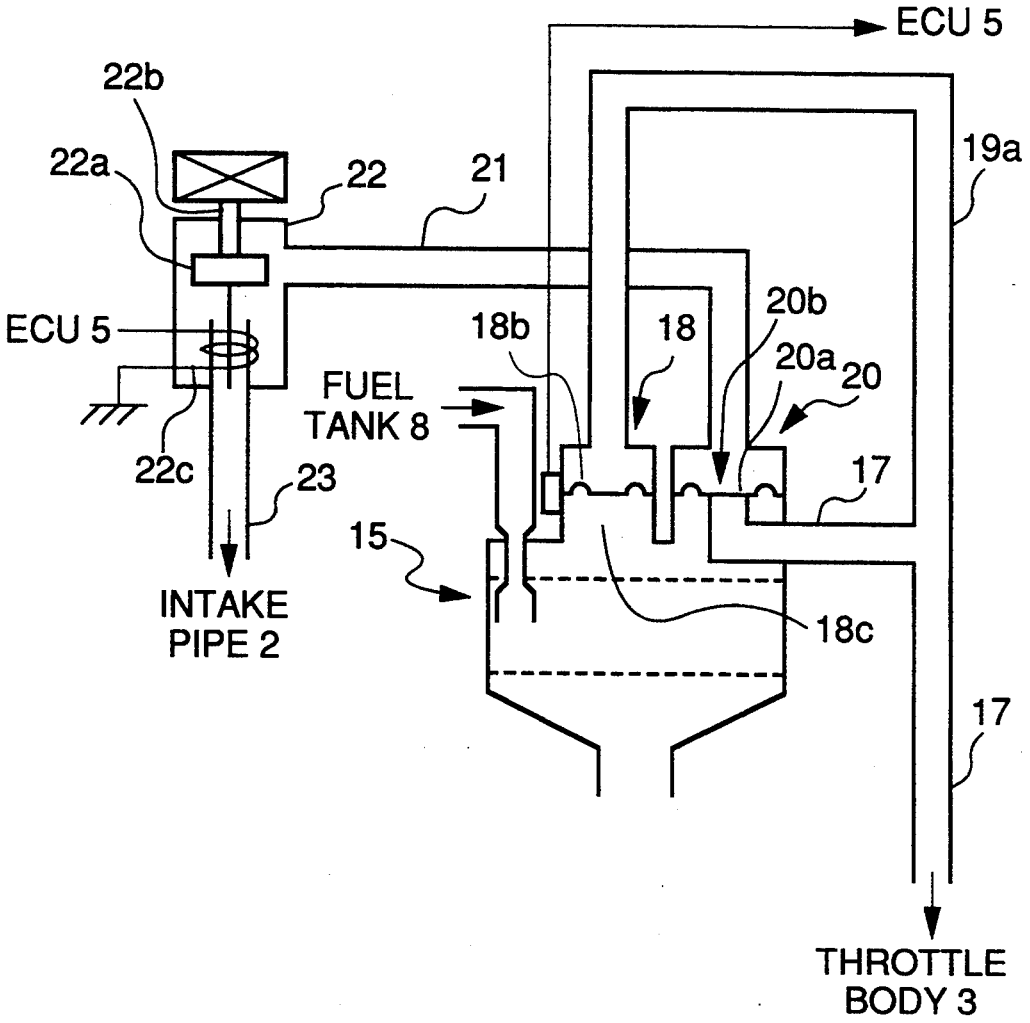
FIG. 4 is a block diagram showing another variation of the embodiment shown in FIG. 2.

FIG. 4 shows another variation of the embodiment. This variation is distinguished from the above described variation in that the pipe 19*b* is omitted, and the pressure sensor 18 is formed integrally with the canister 15 in a fashion that the second pressure chamber 18*c* of the pressure sensor 18 directly opens into the interior of the canister 15. The remaining part of this variation is identical in construction to the FIG. 3 variation, description of which is omitted.

Although the differential pressure-type pressure sensor 18 is used in the above embodiment and its variations, this is not limitative, but a differential pressure-type switch may be used instead, which turns on when the differential pressure exceeds a predetermined value.

What is claimed is:

1. In an evaporative emission control system for an internal combustion engine having a fuel tank and an intake passage, including a canister for adsorbing evaporative fuel generated from said fuel tank, a purging passage connecting between said canister and said intake passage, for purging a mixture of said evaporative fuel and air from said canister into said intake passage, a purge control valve arranged at said purging passage for controlling a flow rate of said evaporative fuel purged into said intake passage via said purging passage, and control means for delivering a valve opening command for opening said purge control valve, the improvement comprising:

abnormality-detecting means for detecting abnormality of said evaporative emission control system, based on pressure within said purging passage at a location between said purge control valve and said intake passage and pressure within said cannister, when said control means delivers said valve opening command.

2. An evaporative emission control system according to claim 1, wherein said abnormality-detecting means comprises a pressure detection passage extending between said canister and a portion of said purging passage downstream of said purge control valve, and a differential pressure-responsive element connected to said pressure detection passage for operation responsive to a difference between pressure in or from said canister and pressure in said purging passage at said location between said purge control valve and said intake passage.

3. An evaporative emission control system according to claim 2, wherein said differential pressure-responsive element comprise a first pressure chamber communicating with an interior of said canister, a second pressure chamber communicating with an interior of said purging passage, and a movable element interposed between said first pressure chamber and said second pressure for operation responsive to a differential pressure between said first pressure chamber and said second pressure chamber.

4. An evaporative emission control system according to claim 3, wherein said differential pressure-responsive element comprises a pressure sensor for detecting said differential pressure between said first pressure chamber and said second pressure chamber, said abnormality-detecting means including determining means for determining that said evaporative emission control system is abnormal if said differential pressure detected by said pressure sensor when said control means delivers said valve opening command is above a predetermined value.

5. An evaporative emission control system according to claim 3, wherein said differential pressure-responsive element comprises a differential pressure-type pressure switch disposed for switching operation responsive to said differential pressure between said first pressure chamber and said second pressure chamber.

* * * * *